United States Patent [19]

Clark et al.

[11] Patent Number: 4,651,012

[45] Date of Patent: Mar. 17, 1987

[54] HIGH BRILLIANCE LENSLESS PROJECTION SYSTEM OF TEST PATTERNS

[75] Inventors: Benton C. Clark, Littleton; Todd E. Crumbaker, Fort Collins, both of Colo.

[73] Assignee: Martin Marietta Corporation, Bethesda, Md.

[21] Appl. No.: 714,336

[22] Filed: Mar. 21, 1985

[51] Int. Cl.[4] ..... G21K 1/02

[52] U.S. Cl. ..... 250/505.1; 378/149

[58] Field of Search ..... 250/505.1; 378/149; 350/319, 163; 354/101, 102; 353/38, 120

[56] References Cited

U.S. PATENT DOCUMENTS

| | | | |
|---|---|---|---|
| 3,869,615 | 3/1975 | Hoover | 378/149 |
| 3,936,771 | 2/1976 | Kallis | 350/319 |
| 4,105,318 | 8/1978 | Yevick | 353/38 |
| 4,114,168 | 9/1978 | Yevick | 354/102 |
| 4,460,832 | 7/1984 | Bigham | 250/505.1 |
| 4,506,374 | 3/1985 | Flynn | 250/505.1 |

*Primary Examiner*—Bruce C. Anderson

*Attorney, Agent, or Firm*—Sughrue, Mion, Zinn, Macpeak and Seas

[57] ABSTRACT

A projection system derived from certain solid geometrical properties using two aperture plates bearing arrays of holes with well defined spacing projects radiation from diverse sources such as electromagnetic radiation, visible and invisible light radiation, discrete particles, X-rays, gamma rays, charged and uncharged particles, as a multi-dot radiation image pattern onto a distant target, overcoming the enormous intensity losses inherent in prior art for pin hole projection of test patterns. The source angular emission function may be of nearly any type, from omni-directional (perfectly diffuse) to uni-directional. Such dot patterns are suitable for evaluating imaging systems as well as the critical operating parameters of mapping spectrometer sensors. The lensless projection system is capable of superimposing radiation source rays from every hole in the first aperture plate onto each image dot at the focal plane with dramatic increase in intensity of the projected image.

27 Claims, 9 Drawing Figures

APERTURE PLATE HOLE ARRAY # 1
(4x4) (SPACING = 1)
APERTURE PLATE HOLE ARRAY # 2
(4x4) (SPACING = 1/2)

APERTURE PLATE HOLE ARRAY # 1
(4x4) (SPACING = 1)
APERTURE PLATE HOLE ARRAY # 2
(2x2) (SPACING = 1/2)

APERTURE PLATE HOLE ARRAY # 1
(4x4) ( x SPACING = 1 )
( y SPACING = 1/2 )

APERTURE PLATE HOLE ARRAY # 2
(4x4) ( x SPACING = 1/2 )
( y SPACING = 1/4 )

HIGH BRILLIANCE LENSLESS PROJECTION SYSTEM OF TEST PATTERNS

FIELD OF THE INVENTION

This invention is directed to the projection of radiation test patterns onto distant targets, and more importantly, to a projection system which maximizes the intensity of the image dots at the projection system focal plane.

The projection of wave energy, particularly visible light, has been effected satisfactorily in some cases by passing such light through a pin hole or multiple pin holes within an opaque planar member such as a thin sheet. A known advantage of pin hole projection systems, i.e. the pin hole camera, is that no objective lens is needed, and perfect focusing of the image occurs at any depth of field.

It has been recognized that certain advantages may be obtained by utilizing a pair of aperture plates bearing a square array of pin holes of different size or diameter and interposed between a radiation source and a target spaced respectively to the sides of the aperture plates.

U.S. Pat. No. 3,204,091 to A. J. Baracket is directed to an improved light source capable of varying the intensity of the light without changing its color temperature as utilized in illuminating photographic slides and provides visible light with substantially uniform and controllable intensity over the face of the slide. The light source of that patent is exemplified by three fluorescent tubes positioned within a box closed at one end by a light diffusing plate. The slide to be viewed is positioned directly in front of a light diffusing plate. Behind the light diffusing plate, are positioned two foraminous opaque members, the first of which is located in a fixed position directly across the path of light to the diffusion plate and slide, and the other of which, is parallel to the first but is movable in a direction parallel to the plane of the two opaque members. Pin holes with varying space-size parameters are provided such that movement of the second foraminous plate relative to the first varies the overall intensity of light passing through the plates without varying the relative intensity of the various color components of the light. This produces a uniform, featureless illumination.

U.S. Pat. Nos. 4,073,650, 4,105,318, and 4,114,168 to George J. Yevick are directed to recording of macroscenes on an optical fiche utilizing a transparent sheet having a photographic emulsion on its bottom surface and an opaque coating apertured by a plurality of pin holes on its top surface. The macroscene is projected through a coarse mask provided with a plurality of openings with the macroscene being spaced from the coarse mask and the coarse mask openings being parallel and continguous to the pin holes. The unique set of pin holes carried by the fiche are aligned with the coarse mask openings and the number of coarse mask apertures is less than the number of pin holes. Each coarse mask aperture is in a cell defined by opaque septa to prevent optical cross-talk between the pin holes of different sets. The Yevick patents involve the concept of replacing microlenses conventionally employed with pin holes and neither these patents nor that of Baracket are directed to overcoming enormous radiation intensity losses inherent in pin hole projection.

It is, therefore, a primary object of the present invention to provide a projection system for the projection of test patterns onto a distant target which eliminates the high radiation intensity losses inherent in known pin hole projection systems and wherein the test patterns so projected are of high quality and sharpness.

It is a further object of the present invention to provide a high brilliance lensless projection system for the projection of test patterns using a wide variety of radiation sources from omni-directional to uni-directional and which system is particularly useful in the projection of test patterns for sources that cannot be conventionally focussed, such as X-rays, gamma rays, uncharged particles and the like.

SUMMARY OF THE INVENTION

The high brilliance lensless radiation source projection system of the present invention for the projection of radiation against a target surface comprises a source of radiation and two planar, parallel aperture plates, the perpendicular to which defines the optical axis. The first opaque aperture plate bearing a first pattern of holes in a rectangular array is positioned at or near the source. The second opaque aperture plate bearing a second pattern of holes in a rectangular array is positioned between the first aperture plate and the target surface and oriented parallel to the first aperture plate. The improvement resides in the second aperture plate being placed at a position such that the dot image pattern is focussed on the target surface under conditions corresponding to placement of the second aperture plate at the perpendicular-bisection of the optical axis, and wherein the relation of the hole spacings on the second aperture plate and relative to those of the first aperture plate is of the form 0.5(n); where n is an integer, whereby a dot radiation pattern image is effected on the target surface characterized by superimposition of multiple radiation source dots from the first aperture plate through the second aperture plate onto a given dot of the radiation pattern image.

Depending upon the linear density ratio of the first and second aperture plates, focus of the image pattern occurs with the second aperture plate located at 0.25, 0.50 and 0.75 of the distance from first aperture to target. With the focus occurring at 0.25 of the source to target distance from the source, for circular openings the projection appears visually as three dimensional high-lighted spheres because the intensity distribution across the image dots is strongly peaked at the center.

The system may be such that the holes within the second aperture plate are larger than the holes within the first aperture plate to improve the sharpness of the image pattern dots on the target surface. Alternatively, the second aperture plate may have twice the linear density of holes as that of the first aperture plate, such that each image dot on the target surface is composed of radiation emanating from every hole in the first aperture plate.

With the first aperture plate having three times the linear density of holes as that of the second aperture plate, 1/6 of the holes in the first aperture plate contribute to the creation of each radiation image dot impinging the target surface.

The target may comprise a partial or total light radiation transmissive plate to define a backlighted dot radiation pattern image on the side of the radiation transmissive plate remote from the radiation source. One or more radiation attenuation screens may be provided between the aperture plates or between the second aperture plate and the target surface. However, such screens must be absorbtive only, and not diffusive because scattering will destroy the focusing properties.

Precisely focussed radiation stripe patterns may be effected either horizontally or vertically by utilizing a second aperture plate with slotted openings rather than holes, with the parallel slots having the same spacing as that which would be employed for spacing the holes. The crossing of two such slotted apeture plates produces square dots. The slots of the second aperture plate may be subdivided into multiple mini-slots conveniently producing high and low resolution patterns. The slots may be colored and the projected colors may be preserved or mixed. For example, alternating rows of red and green dots within the first aperture plate permit a pattern of alternating red and green stripes to be projected with slots within the second aperture plate aligned parallel to the colored row, whereas white stripes are projected onto the target surface when the slots are aligned perpendicular to the rows. This concept may be extended to three or more colors by choice of ratio of linear density of dot spacings between the two apertures.

It is to be noted that for non-visible radiation, the concept of color projection may be replaced by the concept of projection of monoenergetic bands.

If the "beam" is reflected from a specular surface on either side of the second aperture, the focussing properties of the high brilliance lensless projection system are maintained, and a folded optical path is effected for those types of radiation for which specular reflectors are employable.

A screen may be employed, rather than the focal plane of an instrument functioning as the target surface. The screen can be reflective, transmissive or partially transmissive (beam-splitting). The screen can constitute a mirror with the pattern visible from nearly all angles because the pattern is formed by converging rays covering a broad angular range. The screen can be made with the desired pattern provided thereon, as for instance by being painted with white dots or formed as a black aperture plate with a strong reflector just behind it to enhance the contrast of the projected pattern even when viewed in strong background light. The screen can be an opaque aperture plate with holes matching the pattern (rear-projection mode) with the transmitted intensity peaking when the patterns match. The transmitted flux may also serve as a new projection source.

DESCRIPTION OF THE PREFERRED EMBODIMENTS

Figure 1:
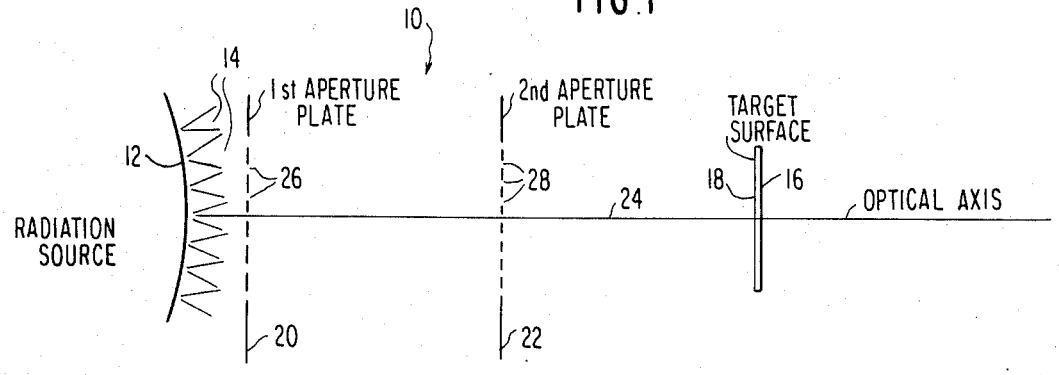
FIG. 1 is a schematic diagram of the basic components of the high brilliance lensless projection system of the present invention.
Figure 2A:
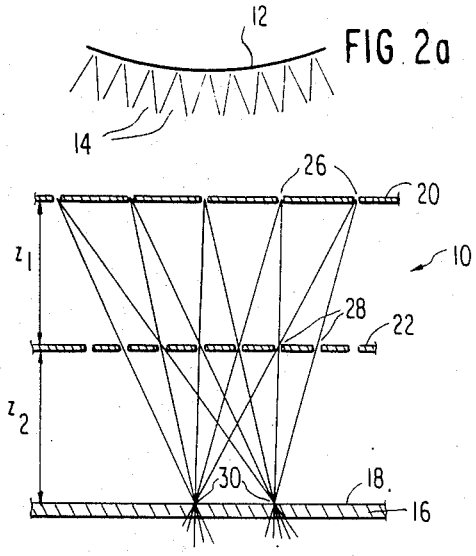
FIG. 2*a* is a schematic diagram of a portion of one embodiment of the present invention, wherein the second aperture plate has twice the linear density of holes as that of the first aperture plate.
Figure 2B:
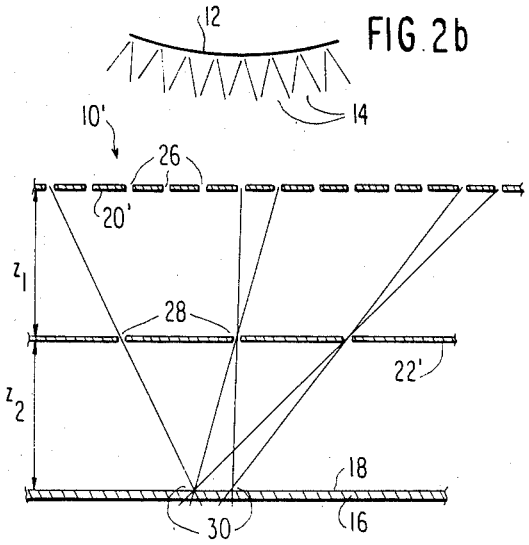
FIG. 2*b* is a schematic diagram of a portion of a further embodiment of the invention wherein the linear density of holes of the first aperture plate is three times that of the second aperture plate.

The lensless projection system for projection of radiation from diverse radiation sources with minimal radiation intensity loss is based on a concept which may be appreciated by reference to FIGS. 1, 2*a* and 2*b*. To construct the projection system, it is only necessary to provide three basic elements, absent the target surface itself.

In FIG. 1, the lensless type projection system, indicated generally at 10, is comprised of a radiation source indicated generally at 12, emitting rays 14 in the general direction of a target 16 having a target surface 18 facing that source of radiation. While the source illustrated may constitute a light bulb with the light emitted being principally visible light, a variety of omni-directional or uni-directional radiation sources may be employed, including but not limited to a multiplicity of point sources. The radiation may constitute electromagnetic radiation or discrete particles, but the invention may be particularly valuable for sources which cannot be easily focussed such as X-rays, gamma rays, uncharged particles, gas molecules, fluidized particulates, and vacuum ultraviolet. Radiation may be effected by one or more sources of the group consisting of radio waves, sound waves, charged atomic particles, radioactive sources, a neutron flux, fluidized macroscopic particles, debris clouds, accelerated dust, bouncing balls, liquid droplets, aerosol, plasma, ultraviolet light, infrared radiation, ions, sputtered molecules, evaporated atoms or any other collection of particles or corpuscular radiation.

Since the pattern production in the present invention is purely by mechanical means, it is a true achromatic system compared to optical systems which use refracting optics (lenses). Thus, the projector can be set up, aligned and tested, using some convenient source such as visible light and the source radiation may be changed to something else, such as IR or X-rays, and the pattern fidelity will be precisely the same. In nearly all conventional systems, great effort and complexity is required to make the optical train achromatic, by adding compensating lenses, etc.

The key to the projection system lies in the nature and use of a pair of aperture plates. A first aperture plate indicated generally at 20 is placed at or near the source 12. A second aperture plate 22 is placed in the illustrated embodiment, FIG. 1, at the bisection of optical axis 24 between the first aperture plate 20 and the target surface 18 and oriented parallel to the first aperture plate. The optical axis 24 is the connecting line from first aperture plate to target. If the radiation source has a preferred direction of emission, this radiation direction is aligned parallel to the optical axis 24 in order to achieve maximum intensity of illumination of radiation at the target 16.

The pattern of holes 26 in the first aperture plate 20, which holes may be circular, rectangular or the like in cross-section, or a square array. In the second aperture plate 22, holes 28 also preferably form a square array. That is, preferably in both aperture plates, the holes are equally spaced both laterally and vertically from each other and form a series of rows of holes across the plates. Holes 26 and 28 may constitute pin holes, however, the term "pin hole" denotes a very small opening, but this invention is not at all limited by hole size, except for diffraction effects, which are best overcome by large holes. The plate 20, therefore, includes a plurality of rows of laterally spaced holes 26 which rows themselves are vertically spaced to form the square array of holes 26. In similar fashion, holes 28 are formed as a square array at laterally spaced positions and in vertically spaced rows within the second aperture plate 22.

Further, as a key aspect of the present invention, the hole spacings for the second aperture plate 20 relative to the first aperture plate 22 must be of the form $0.5(n)^{-1}$ where n is any integer.

Turning to FIG. 2*a*, there is illustrated a schematic representation of the nature in which radiation, in this case visible light from source 12, is projected through the holes 26 of the first aperture plate 20 and the holes 28 of the second aperture plate 22, so as to impinge on the target surface which is at the focal plane for the light emanating from the source 12. The linear density ratio between the hole spacings of the first aperture plate 20 relative to the second aperture plate 22, is 1 to 2, meaning that the second aperture plate 22 has twice the linear density of holes 28 as the density of holes 26 within the first aperture plate 20, as shown in FIG. 2*a*.

As a result, each radiation pattern image dot 30 on the target surface 18 of target 16 receives light rays from every hole 26 within the first aperture plate 20. FIG. 2*a* also shows the focussing effect for the light rays 14 at distance $Z_1$ which is the distance from the first aperture plate 20' to the second aperture plate 22', $Z_2$ being the distance between the second ature plate 22' and the target 16. The first aperture plate 20', the second aperture plate 22', and the target 16 are located in the same relative positions as in the embodiment of FIG. 2*a*, $Z_1=Z_2$. However, in this case, there is a 3 to 1 linear density ratio for the holes 26 of first aperture plate 20' relative to holes 28 of the second aperture plate 22'. The diagrammatic illustration of FIG. 2*b* shows the focusing properties when the linear density of holes in the first aperture plate is three times greater than those of the second aperture plate 22'. The total number of holes is nine times greater in the first aperture plate 20' than in the second aperture plate 22'. In this case, 1/6 of the holes 26 in the first aperture plate 20' contribute to the formation of each image dot 30 at target surface 18 at the focal plane for lensless projection system 10' forming the embodiment of FIG. 2*b*.

Figure 3:
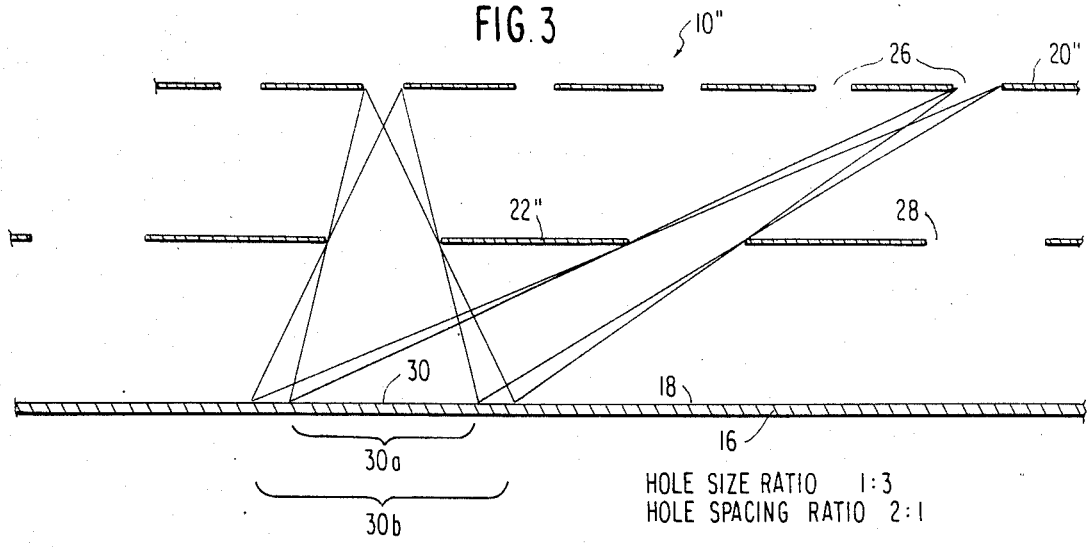
FIG. 3 is a schematic view of a portion of the lensless projection system of the present invention illustrating the exact overlap of umbra and penumbra regions of the radiations, independent of the source path, for an embodiment of the invention wherein the hole size ratio is 1 to 3 and the hole linear density ratio is 2 to 1 for the first aperture plate relative to the second aperture plate.

In the embodiment of FIG. 3, it is assumed that an omnidirectional light source (not shown) is employed for the radiation to be transmitted to the target surface 18 for target 16 using a hole projection system 10''. The first aperture plate 20'' is provided with holes 26 having a hole size ratio of 1 to 3 relative to the second aperture plate 22'' and its pin holes 28. Additionally, the linear density of holes, i.e. hole spacing ratio for the first aperture plate 20'' relative to the second aperture plate 22'', is 2 to 1 for this embodiment. The embodiment illustrated in FIG. 3 shows the exact overlap of the umbra and penumbra regions independent of the source path. The creation of a radiation pattern image of dots 30 is effected via radiation from multiple pin holes 26 within the first aperture plate 20'' and which radiation, in turn, passes through the holes 28 of the second aperture plate 22''. Exactly the same overlap of umbra 30*a* by the the penumbra 30*b* region occurs irrespective of the source path of the light radiation forming a given radiation pattern image dot 30 on target surface 18.

Other important properties of the image dots 30 for the respective embodiments are evaluated in Tables I and II below.

TABLE I

| Relative Hole Spacing | | | | |
|---|---|---|---|---|
| 1st Aperture Plate | 2nd Aperture Plate | At target | # of colors | Relative intensity per dot |
| 3 | 1 | 3 | 6 | 0.16 |
| 5/2 | 1 | 5/2 | 5 | 0.20 |
| 2 | 1 | 2 | 4 | 0.25 |
| 3/2 | 1 | 3/2 | 3 | 0.33 |
| 1 | 1 | 1 | 2 | 0.50 |
| 1 | 2 | 1 | 1 | 1.00 |

TABLE II

| Effects of Relative hole Sizes | | | | | | | | |
|---|---|---|---|---|---|---|---|---|
| Opening Diameters | | Diameters | | | | | Relative | |
| 1st Aperture Plate | 2nd Aperture Plate | Umbra | Penumbra | Dot Rel Brilliance (10 g/p 2) | U/P Ratio | Source Area | Solid Angle | Geom Factor (g) |
| 1 | 5 | 9 | 11 | 2.1 | 0.82 | 1 | 25 | 25 |
| 1 | 4 | 7 | 9 | 2 | 0.78 | 1 | 16 | 16 |
| 1 | 3 | 5 | 7 | 1.8 | 0.71 | 1 | 9 | 9 |

TABLE II-continued

| Opening Diameters | | Effects of Relative hole Sizes | | | | | Relative | |
|---|---|---|---|---|---|---|---|---|
| 1st Aperture Plate | 2nd Aperture Plate | Diameters Umbra | Diameters Penumbra | Dot Rel Brilliance (10 g/p 2) | U/P Ratio | Source Area | Solid Angle | Geom Factor (g) |
| 1 | 2 | 3 | 5 | 1.6 | 0.60 | 1 | 4 | 4 |
| 1 | 1 | 1 | 3 | 1.1 | 0.33 | 1 | 1 | 1 |
| 2 | 1 | NA | 4 | 2.5 | NA | 4 | 1 | 4 |
| 3 | 1 | NA | 5 | 3.6 | NA | 9 | 1 | 9 |
| 4 | 1 | NA | 6 | 4.4 | NA | 16 | 1 | 16 |
| 5 | 1 | NA | 7 | 5 | NA | 25 | 1 | 25 |

It should be noted that for very sharp dots, the second aperture plate 22″ should have larger holes 28. However, if triangular intensity distributions are satisfactory, greater throughput of the source intensity is possible (for equal penumbrae 30*b*) with the larger holes within the first aperture plate 20, 20′, 20″ etc.

Table I lists the effects of relative hole spacing, i.e. the density ratio, while Table II illustrates the effects of the relative hole sizes for the first and second aperture plates, i.e. hole size ratio.

In terms of dot relative brilliance, it may be appreciated by reference to Table II, that if the hole or opening diameters for the first aperture plate 20 are four times that of the opening or hole diameters for the second aperture plate, the relative dot brilliance is four times that if the hole sizes are the same.

It should be noted that other geometrical solutions exist for the placement of the second aperture plate relative to the first aperture plate, but only the bisector is considered in the presentations for FIGS. 1–3 inclusive. In the discussion above, the umbra is defined as full illumination intensity, as opposed to the usual definition of "complete darkness". The pattern of holes in the first and second aperture plates may be rectangular rather than square, provided the $0.5(n)^{\pm 1}$ relationship between the hole densities for respective first and second aperture plates is maintained independently in both dimensions as will appreciated by reference to FIG. 6, discussed hereinafter.

The primary advantage of the projection system of the present invention over previous known pin hole projection systems is a drammatic increase in the radiation intensity of the images. The lensless projection system superimposes all of the source dots onto each image dot, in the embodiment of FIG. 2*a*, whereas conventional pin hole projections pass only one aperture dot to the image dot. This is particularly useful in overcoming the enormous intensity losses inherent in pin hole projection of test patterns onto a distant target.

The method derives from certain solid geometrical properties. The image patterns so produced are suitable for evaluating imaging systems, as well as the critical operating parameters of mapping spectrometer sensors. Using only two aperture plates, an array of image dots with extremely well-defined spacing in intensity profile may be projected onto a detector's sensitive surface irrespective of the source angular emission function which may be of nearly any type from omni-directional to uni-directional. The test pattern so produced can be projected onto a detector sensitive surface for calibration purposes, and this technique is applicable to a wide variety of sources of radiation such as electromagnetic radiation, or discrete particles, but is particularly useful for radiation sources that cannot be conventionally focussed, such as X-rays, gamma rays and uncharged particles.

The focusing relationships expressed in FIGS. 2*a*, 2*b* and 3 are readily subject to theoretical confirmation. Further, these focusing relationships are true also in the three dimensional case, as shown experimentally, theoretically, as below, or by numerical simulation. The theoretical considerations are as follows:

Ray Tracing

Let $X_1$, $Y_1$ be the coordinates of an opening in the first aperture $Z_1$=distance from first aperture plate to the second aperture plate, $X_2$, $Y_2$ be the coordinates of an opening in the second aperture plate, $Z_2$=distance from second aperture plate to target, $X_3$, $Y_3$ be the coordinates where the ray intersects the target.

Then it can be shown $$X_3=X_2+R(X_2-X_1)$$

$$Y_3=Y_2+R(Y_2-Y_1)$$

where $R=(Z_2/Z_1)$

Focusing Condition

If the spacings on the second aperture plate are related to the spacings on the first aperture plate by integral multiples of ½, i.e. by n/2, then $$X_2-X_1=(n/2)X_1$$

from which it can be shown $$X_3=\left(\frac{nR}{2}+\frac{n}{2}+1\right)X_1$$

If R=1, this reduces to $$X_3=(n+1)X_1$$

which completes the proof that the target spacings are integral in (n+1).

Penumbral Width at Focusing Condition (See FIG. 3)

$W_1$=width of holes in aperture plate 1

$W_2$=width of holes in aperture plate 2

$W_3$=penumbral width of dots projected onto target

Then;

$$W_3 = X_2 - X_1 = \left(\frac{Z_1 + Z_2}{Z_1}\right)(W_1 + W_2) - W_1$$

For $Z_1 = Z_2$, then by simplification;

$$W_3 = 2W_2 + W_1$$

Figure 4:
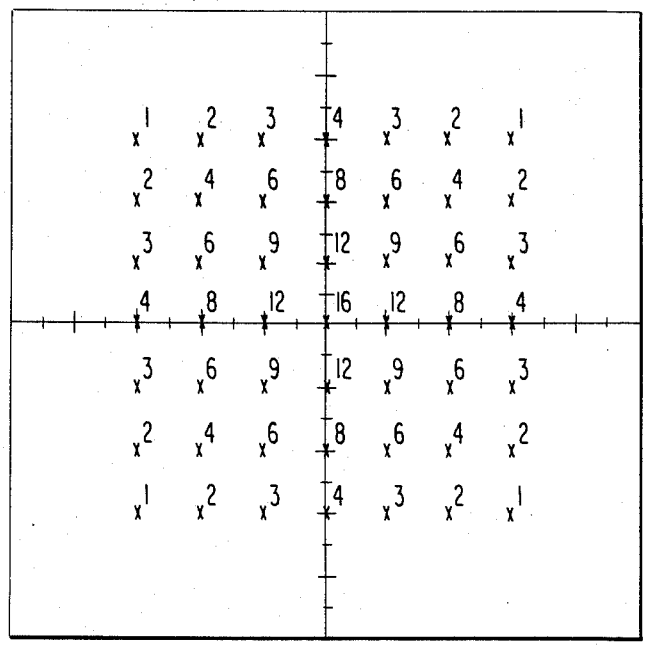
FIG. 4 is a plan view of the ray tracing at the target surface for an embodiment of the present invention for two 4×4 aperture grids showing the image pattern and radiation intensities as a result thereof, with the hole arrays for the first and second aperture plates being identical but with the linear hole spacings 2 to 1 for the first aperture plate relative to the second. Note from the numbers representing intensities that the dots are not all of equal intensity for these small arrays. However, for much larger arrays (100×100, or 1000×1000), the intensities of the dots are almost equal, except toward the edges of the pattern.
Figure 5:
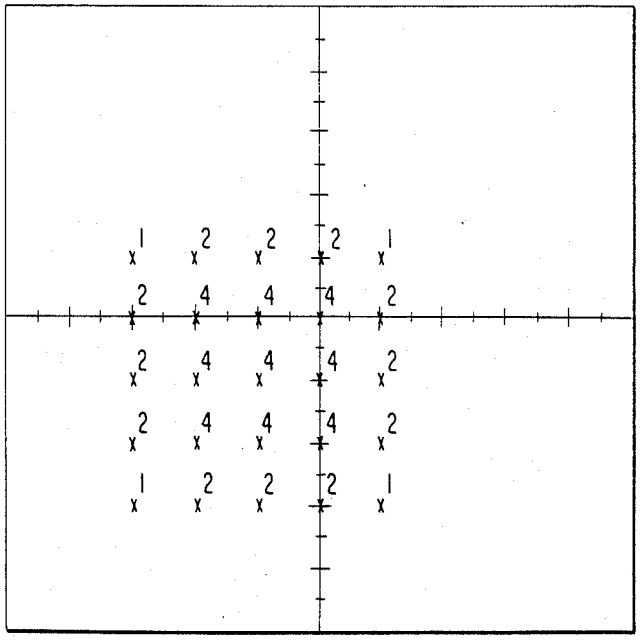
FIG. 5 is a ray tracing diagram at the target surface for an embodiment of the invention in which the two different sized hole arrays are provided for the first and second aperture plates, and wherein the hole spacing is 2 to 1 for the first aperture plate relative to the second aperture plate.
Figure 6:
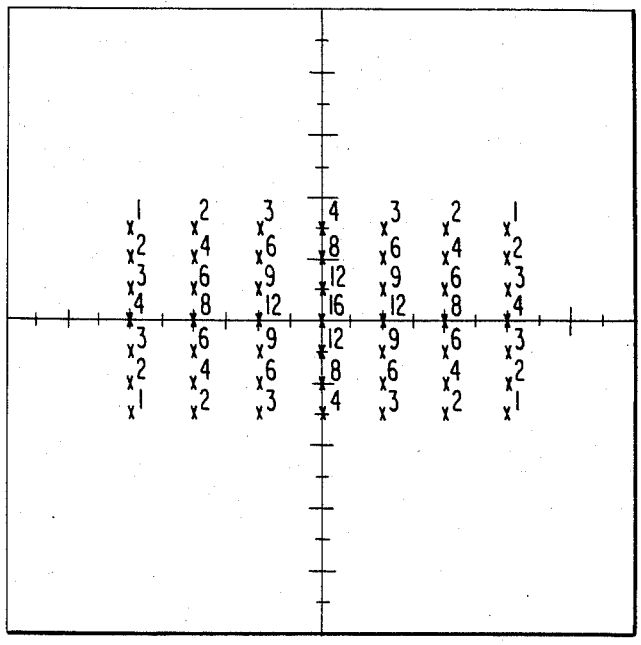
FIG. 6 is a ray tracing diagram for the dot radiation pattern image at the target for an embodiment of the invention in which the pair of aperture plates have the same sized hole array, but wherein the X and Y spacing for the holes vary for the first and second aperture plate, and the hole spacing for the second aperture plates is one-half that of the first aperture plate.

Referring to FIGS. 4, 5 and 6, ray tracings at the focal plane for three different aperture plate conditions illustrate the nature of the image pattern and the relative light (or other radiation) intensity of the image pattern dots at their specific locations within the particular patterns created by the projection system of the present invention.

In FIG. 4, a ray tracing is shown for two 4×4 aperture plate hole grids. In this case, the image pattern is created by a first aperture plate where the aperture plate hole grids are identical, i.e. 4×4, with the ratio of the hole spacing ratio, plate 1, relative to that plate 2, being 2 to 1. In this case, the spacing of the holes in aperture plate 1 are one inch apart and the spacing within aperture plate 2 of the holes therein are one-half inch apart, each in a square array.

In FIG. 5, the first aperture plate and second aperture plate have not only different sized aperture plate hole grids, but also different hole spacing relative to that of FIG. 4. The ray tracing of FIG. 5 is one resulting from the first aperture plate having a 4×4 aperture plate hole grid, with the holes being spaced one inch apart; and the second aperture plate having an aperture plate hole grid of 2×2 with the holes being spaced one-half inch apart. A different trace pattern is formed with the number of points having equal light intensity increasing relatively.

In FIG. 6, instead of the hole grids being formed such that the holes are in a square array, the arrays are rectangular, and with the X spacing for the holes at one inch and the Y spacing at one-half inch for the first aperture plate. The second aperture plate has its holes at an X spacing equal to one-half inch and a Y spacing equal to one-fourth of an inch. The aperture plate hole grids for the two aperture plates remain the same at 4×4 inches. Under these conditions, the rectangular aperture plate hole arrays for first and second aperture plates "focus" at the image plane, i.e. target surface 18, to a rectangular image with the dots having relative light intensity at various positions within that image of the values numerically shown.

It may be appreciated from the above that the high brilliance, lensless projection system of the present invention has excellent application in the projection of patterns of non-optical, non-focusable radiation. Even under conditions where visible light is to be projected and the alternative is the use of conventional optical elements such as lenses, it is believed that the lensless projection system would have significant advantages over those using such lenses.

First of all, high quality lenses are very expensive, especially where wide-field acromatic systems are required. The system of the present invention requires no glass, no intricate coatings, no compensating elements, and very modest alignment. It is inherently wide-field. The aperture plates may be cheaply manufactured and mass produced to extremely high precision using well-established photo-lithography or numerically-controlled machining techniques to produce the aperture plate hole patterns.

Additionally, the system works with a uni-directional source since then it becomes simply a collimater with aligned double apertures. A diffuse source may be readily produced. For example, plating a radiation-emitting material onto a flat sheet is a very common procedure and produces highly uniform omni-directional source radiation.

As stated previously, in addition to a focus occuring at 0.5 of the source to target distance from the source, two additional focii occur with the second aperture plate located 0.25 of the source to target distance, from the source, and 0.75 of that distance, FIG. 3.

Further, for circular aperture plate holes, the 0.25 projection appears visually as three dimensional highlighted spheres. This is because the intensity distribution across the dots strongly peaks at the center.

It is also possible to produce precisely focused stripe patterns. This is done by replacing the second aperture plate with a plate having slotted openings rather than round or square holes. These parallel slots must have the same spacing as would be used for spacing the holes of the second aperture plate. Replacing the first aperture plate also with slots and then crossing two such slotted aperture plates produces square dots.

These slots may be subdivided into multiple mini-slots to conveniently produce combined high and low resolution patterns. Also, colors may be either preserved or mixed, as desired. For example, with alternating rows of red and green dots within the first aperture plate, a pattern of alternating red and green stripes can be projected with the slots of the second aperture plate aligned parallel to the colored hole rows of the first aperture plate, whereas white strips are projected when the slots of the second aperture plate are sligned perpendicular to the colored hole rows of the first aperture plate.

The aperture plate base material for plates 20, 22, etc., must be non-transmissive, that is, opaque as described to the radiation or particle flux being projected onto the target surface. The openings or holes in the first aperture plate may be either empty or filled with a suitable highly-transmissive scattering medium. A scatterer (or diffuser) is desirable when the source is directional. It is mandatory if the source is divergent, such as a point emitter. The source-side of the first aperture plate 20, etc., should be highly reflective, whether specular or diffusive, so that flux which does not penetrate the openings has the opportunity to be scattered again from the source.

The target-side of the first aperture plate 20, 20', 20'' should be perfectly absorbing so that the flux which is reflected or scattered from the second aperture plate 22, 22', 22'' cannot be rescattered from this side of the first aperture plate and spoil the sharpness of the pattern produced.

With respect to the second aperture plate, the material making up this plate must also be opaque. The openings or holes 28 within the second aperture plate must be totally empty, as any scattering material can destroy or damage the image pattern at the target surface 18. The source side of the second aperture plate should be highly reflective if maximum intensity is required. Reflected flux can, with some probability, re-enter the source 12 through the holes 26 of the first aperture plate and hence be recycled. Ideally, this surface should be composed of retroreflectors as, for instance, corner cubes or cat's eyes, so that the non-transmissible rays are sent back through the first aperture plate holes 26 into the source region to be recycled.

The target side of the second aperture plate 22, 22', 22'' should be highly absorbing since flux reflected from the target 16 can strike it and then reflect again to the target in a random pattern.

For maximum intensity, it is desirable that the source 12 be transparent and reflective of its own flux. For this purpose, a reflective wall around the source is desirable. In some applications, a "source cavity" may be in order, whereby the first aperture plate is combined with such a wall to form an enclosed chamber. For example, if the internal walls of such a cavity were perfectly reflective, then multiple reflections would eventually permit all of the source flux from a source such as source 12 to eventually emerge from the holes 26 within the first aperture plate 20, 20', 20''. This will result in large increases of brilliance in the dot pattern at the target surface 18.

By mathematical derivation, the intensity of the image dot for a fixed source strength is proportional to the relationship $$\left(\frac{W_1 W_2}{P_1 Z_1}\right)^2$$

where;

$W_1$ and $W_2$ are the diameters of the openings 26 and 28 in aperture plates 20, 22, respectively and $P_1$ is the inter hole spacing in the first aperture plate 20 and $Z_1$ is the distance between the aperture plates 20, 22.

This condition holds only when the source-side of the first aperture plate 20 is perfectly absorbing. If the reflecting first aperture concept is employed, the image dot intensity becomes higher and is proportional to the quantity $$\left(\frac{W_2}{Z_1}\right)^2$$

In a practical sense, the present invention also has utility in the creation of an intense thermal infrared radiation pattern suitable for accomplishing heat sealing of plastic sheets or the like, analogous to spot heater devices but without physical contact necessary between the heat source and the laminate being heat sealed.

The identification of a target object traversing perpendicularly across the projected radiation or field offers unique possibilities. If the target object is provided with a pattern of reflective dots on an absorbing background, there will be a strongly enhanced momentary reflection at the instant of alignment between the projected pattern and the body-fixed pattern.

Figure 7:
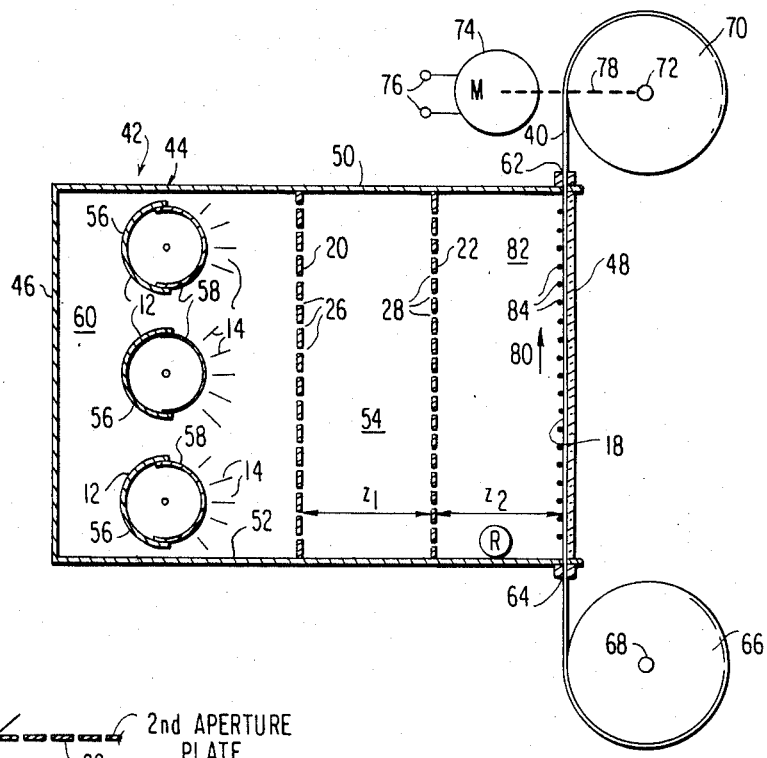
FIG. 7 is a schematic vertical sectional view of an embodiment of the improved hole projection system of the present invention in which a moving film bearing a fixed pattern of reflective dots, corresponding exactly in size and postion to that producable by the projection system itself, is carried by a film which is movable in the plane of the projection system target surface and having means to sense the superimposition of the image dot pattern on the reflective dot pattern of the film passing through the target plane.

Reference to FIG. 7, shows a simplistic system as a schematic rendition utilizing the principles of the embodiments previously discussed to effect superimposition of an optical image dot pattern on a pattern of reflective dots carried by a moving film 40 functioning as the target object. In that respect, the projection system indicated generally at 42 is comprised of a boxlike structure indicated generally at 44; having a rear wall 46 and a front wall 48 at opposite ends, a cover at 50, a bottom wall 52, and one sidewall 54, the opposite sidewall being removed to show the interior of the box 44. Mounted within the box are three light sources 12 in the form of fluorescent tubes whose axes are horizontal. The light sources may have a rear reflector as at 56 which reflects light through a transparent front portion 58 of the fluorescent tubes in the form of light rays 14. A first opaque aperture plate 20 is provided with holes or perforations 26, and a similarly formed second opaque aperture plate 22 is provided with apertures with openings or holes 28, all in the manner of the embodiment of FIG *2a*, as square or rectangular arrays. Purposely, all around the light sources 12 within chamber 60 housing the light sources 12, there is provided a reflective surface, even on the surface of the first aperture plate 20 facing the sources 12. For maximum intensity, a source or sources 12 could be totally transparent and reflective of its own flux. This maximizes the brilliance in the dot pattern reaching the target surface as defined by film 40. Box 44 is essentially lightproof. There are aligned horizontal slots as at 62, 64 (with appropriate light seals) within the top 50 and bottom 52 of the box 44 through which horizontal slots the film 40 traverses from a supply reel 66 mounted horizontally for rotation about its axis 68 to a take up reel 70, also mounted horizontally for rotation about its axis 72. A motor 74 may be supplied by an electrical power source (not shown) via leads 76. The motor is connected directly to the reel 70 via a suitable shaft 78, thereby driving the take up reel 70 when energized to move the film 40 vertically upwardly within the box 44 and specifically within compartment 82, as shown by arrow 80. The film 40 forms the target surface 18 facing the holes 28 of the second aperture plate 22. The film 40 is thus spaced at a distance Z from the second aperture plate 22, and in accordance with requirements, the second aperture plate 22 is spaced from the first aperture plate 20 by a distance Z1.

A reflective dot pattern is formed by multiple reflective dots 84 on the surface of the film 40 facing the light radiation passing through the holes 28 of the second aperture plate 22. A radiation sensor R is positioned within chamber or cavity 82 facing the moving film 40 so as to measure the intensity of light passing through the second aperture plate and impinging on the target surface 18 defined by film 40. The pattern of dots 84 on the surface of the film 40 is positioned on the film 40 such that as the pattern of dots traverses vertically and perpendicularly across the projected dot image by projector 42, there will be a strongly enhanced light reflection at the moment of alignment between the projected dot pattern (similar to the pattern of dots 30, FIG. *2a*), and the body-fixed pattern of dots 84 on film 40.

Such a system could be utilized for selectively locating a microfiche image on film 40 at which point a suitable optical projection system (not shown) would project the microfiche stored data onto a screen (not shown) associated with the projection system 42. The dot pattern on film 40 could be specially formed within a light transmissive substrate, and the front wall 48 could be in turn light transmissive so as to permit microfiche image viewing outside of the box 44 along with the coincident pattern of reflective dots and image projected dots of projection system 42. Objects with no pattern or a non-coincident pattern will not show the transient enhanced reflectivity.

Irrespective of utilizing of the projection system in the manner of FIG. 7, it is apparent that the high intensity dot pattern can be projected onto a screen rather than the focal plane of an instrument. The screen may be reflective or transmissive (rear projection) as discussed with respect to FIG. 7, or both by utilizing beam-splitting techniques. The screen can be a mirror, and as a property of this projection technique, the beams will be visible from a wide range of all angles because the pattern is formed by converging rays covering a broad angular range. The screen can be provided with a desired pattern (e.g. painted with white dots) or formed as a black aperture plate with a strong reflector just behind it. This enhances contrast of the projected pattern, even when viewed in strong background light. To systematically vary the apparent contrast, the background light may be varied in intensity. The screen is subject to further imaging if magnifying lenses are available. Under a rear projection mode, the screen can be a black aperture plate with holes matching the pattern. As such, the transmitted radiation intensity will peak when the patterns match. The transmitted flux can also serve as a new projection source.

Precise and accurate attenuation of the projection beam intensity can be accomplished by simply placing a fine screen between two aperture plates or between the second aperture plate 22 and the target. The screen must consist of totally opaque and totally open portions. Any allowed scattering will tend to weaken or destroy the focused pattern. The attenuation factor is simply the inverse of the transmission factor of the screen. Multiple attenuation screens may be used if placed properly. The utilization of one or more attentuation screens is quite effective, since the rays are highly omni-directional as opposed to parallel or paraxial. Since no change in source strength is needed, no radiometric instrumentation is required. All intensities can be determined relatively to one another to great accuracy.

A very large number of variations in the projection system are possible besides the stripe effects mentioned above. The dot pattern projects either white or colored dots, depending upon the 0.25, 0.5 or 0.75 position of the second aperture plate is chosen on the optical axis between the first aperture plate and the target surface. Multiple color dots are produced by simply coloring a single dot on either aperture and flickering and rapidly changing image dots may be easily produced by parallel motions of one or both aperture plates.

The focusing properties of the high brilliance lensless projection system particularly applicable to test patterns are maintained even if the "beam" is reflected from a specular surface on either side of the second aperture plate 22, 22', 22'' etc. This has been successfully demonstrated for the 45-45 degree geometry and may be true for other angles as well. This means the beams can be folded to produce a more compact projector apparatus.

Figure 8:
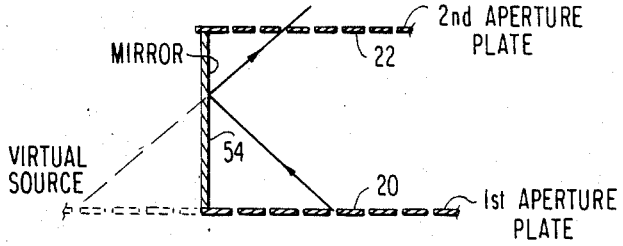
FIG. 8 is a schematic view of a further embodiment of the invention in which a specular reflector further increases the brilliance of the projected pattern.

As illustrated in FIG. 8, utilizing the principle of virtual images, it may be seen that the sidewalls of the high brilliance lensless projection system can be used to increase the intensity output from the second aperture plate 22. To do this, the sides of the second aperture plate must be specularly reflective and oriented with their planes exactly perpendicular to the parallel planes of the two aperture plates and intersecting the first aperture pattern at a line of symmetry. As seen in FIG. 8, sidewall 54 is oriented at right angles to the plane of the first and second aperture plates 20, 22 and intersects the first aperture plate pattern at a line of symmetry. The diffuse scattering components from the sidewalls as at 54 and the opposite sidewall, FIG. 8, will destroy the geometrical pattern so that their mirror quality (specular-to-diffuse ratio) is critically important. Alternatively, the sidewalls as at 54 can be made retroreflective. If neither of these approaches is possible, the sidewalls should be strongly absorbing.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In a high brilliance lensless diverse radiation source projection system for projection of radiation onto a target surface, said system comprising:

a source of radiation, first and second parallel opaque aperture plates, said first opaque aperture plate bearing a first pattern of holes in a rectangular array positioned at or near said source and oriented parallel to said target surface, said second opaque aperture plate bearing a second pattern of holes in a rectangular array positioned between said first aperture plate and said target surface and oriented parallel to the first aperture plate, said aperture plates defining an optical axis perpendicular to both, the improvement residing in said second aperture plate being placed at a position such that the dot image radiation pattern is focussed on said target surface, and wherein the relation of the hole linear spacings on said first aperture plate relative to the hole linear spacings on said second aperture plate is of the form 0.5(n)

where n is an integer, whereby, a dot radiation pattern image is effected on said target surface characterized by superimposition of multiple radiation source dots from said first aperture plate through said second aperture plate onto said target surface.

2. The system as claimed in claim 1, wherein the holes within said second aperture plate are larger than the holes within said first aperture plate, thereby improving the sharpness of the image pattern dots on said target surface.

3. The system as claimed in claim 1, wherein the focus of the image pattern occurs with said second aperture plate located at 0.25 of the first aperture plate-to-target distance from the first aperture plate.

4. The system as claimed in claim 1, wherein the focus of the image pattern occurs with the second aperture plate located at 0.50 of the first aperture plate-to-target distance.

5. The system as claimed in claim 1, wherein the focus of the image pattern occurs with said second aperture plate located at 0.75 of the first aperture plate-to-target distance, from the first aperture plate.

6. The system as claimed in claim 3, wherein said holes constitute circular openings within said first and second aperture plates, and wherein the dot radiation pattern image comprise dots which appear visually as three dimensional high-lighted spheres with the intensity distribution across the image dots being strongly peaked at the center thereof.

7. The system as claimed in claim 1, wherein said second aperture plate has twice the linear density of holes as that of said first aperture plate; whereby, each image dot on said target surface is composed of radiation emanating from every hole in said first aperture plate.

8. The system as claimed in claim 1, wherein said first aperture plate has three times the density of holes as that of said second aperture plate; whereby, one-sixth of the holes in said first aperture plate contribute to the creation of each radiation image dot impinging said target surface.

9. The system as claimed in claim 1, wherein said target comprises at least a partial radiation transmissive plate to form a back lighted dot radiation image on the side of the radiation transmission plate remote from the radiation source.

10. The system as claimed in claim 1, further comprising at least one radiation attenuation screen positioned between one of: the two aperture plates, and the second aperture plate and the target surface, to precisely control the intensity level of the pattern without affecting the energy spectrum of the radiation pattern.

11. A high brilliance lensless diverse radiation source projection system for projection of radiation against a target surface, said system comprising:

a source of radiation, a first opaque aperture plate positioned at or near said source and oriented parallel to said target surface, a second opaque aperture plate being positioned between said first aperture plate and said target surface and oriented parallel to the first aperture plate, said aperture plates defining an optical axis perpendicular to both, spaced holes within said first and second aperture plates, the improvement wherein:

said first aperture plate bears a first pattern of small diameter holes in a rectangular array, said second aperture plate holes have slotted openings in the form of parallel slots having slot spacings corresponding to a rectangular array of small diameter holes in the manner of said first opaque aperture plate, and said second aperture plate is placed at a position such that a dot image pattern is focussed on said target surface under conditions corresponding to placement of said second aperture plate at the bisection of the distance from the first aperture plate to said traget, and the relation of hole spacings on said second aperture plate relative to those of said first aperture plate take the form $0.5(n)^{\pm 1}$, where n is an integer, so as to create precisely focused radiation stripe patterns, either horizontally or vertically, depending upon the orientation of the slots within said second aperture plate.

12. A high brilliance lensless diverse radiation source projection system for projection of radiation against a target surface, said system comprising:

a source of radiation, a first opaque aperture plate positioned at or near the source and oriented parallel to said target surface, a second opaque aperture plate positioned between said first aperture plate and said target surface and oriented parallel to the first aperture plate, said aperture plates defining an optical axis perpendicular to both, the improvement wherein:

said second aperture plate is placed at a position such that radiation passing through said first and second aperture plates is focussed on said target surface under conditions corresponding to placement of said second aperture plate at the perpendicular bisection of the distance from first aperture plate to the target, the relation of hole spacings on said second aperture plate relative to those of said first aperture plate taking the form $0.5(n)^{\pm 1}$, where n is an integer, and wherein said first and second aperture plates include parallel slots having spacing therebetween corresponding to holes defining a rectangular array, and wherein said slots of said first aperture plate and those of said second aperture plate are arranged, parallel to, perpendicular to, or at right angles to each other such that the crossing of said two slotted aperture plates produces square dots, diamonds or stripes at the focal plane on said target surface, depending upon the relative orientation of the slot patterns on the two aperture plates.

13. The system as claimed in claim 1, further comprising a specular surface on either side of said second aperture plate such that a radiation beam is reflected from one of said specular surfaces, thereby maintaining the focusing properties of the high brilliance lenless projection system through a folded optical path.

14. The system as claimed in claim 1, wherein said target surface is defined by a screen or flat spot on a target.

15. The system as claimed in claim 14, wherein said screen or target is reflective.

16. The system as claimed in claim 14, wherein said screen is at least partially transmissive.

17. The system as claimed in claim 14, wherein said screen comprises a mirror; whereby, radiation beams are set up which are visible from nearly all angles because the pattern is formed by converging rays covering a broad angular range.

18. The system as claimed in claim 14, wherein said screen or target comprises an absorbing plate bearing reflecting or colored dots with the screen dots at positions corresponding to those of the image dots to maximize the intensity of the radiation reflected thereby for sensing by a detector.

19. The system as claimed in claim 14, wherein said screen comprises an absorbing aperture plate with holes matching the image dot pattern, providing a rear-projection system with the transmitted radiation intensity peaking when the image dot pattern matches the hole dot pattern on the absorbing aperture plate.

20. The system as claimed in claim 1, further comprising a film mounted for movement through the plane of said target surface, said film carrying on the surface thereof facing the radiation source, a pattern of dots sized to and positioned therein corresponding to the projected radiation image pattern dots, so as to intensify the intensity of the projected dot pattern, and means for moving the film relative to the projected dot image pattern, to effect correspondence in position of the film pattern to that of the projected image pattern.

21. The system as claimed in claim 1, further comprising means for making the first aperture plate source side reflective and the target side perfectly absorbing and for making the second aperture plate source side reflective or retro-reflective and the target side perfectly absorbing for increasing the final brilliance and contrast of the projected image dot pattern.

22. The system as claimed in claim 1, further comprising side walls between the first and second aperture plates which are perfectly specular reflective to increase final intensity of the projected pattern by the principle of superposition of virtual images.

23. The system as claimed in claim 1, wherein the source is enclosed in a highly scattering cavity so that all emissions may, via repeated scattering, have the opportunity to pass through the holes of said aperture plates.

24. The system as claimed in claim 1, wherein the holes in the first aperture plate are filled with transmissive, scattering material to increase the diffuse nature of the source radiation and to produce more uniform intensity from dot to dot.

25. The system as claimed in claim 1, wherein the source and the first aperture plate are replaced by an array of individual point radiation sources arranged in an array equivalent to the hole array of the first aperture plate.

26. The system as claimed in claim 8, further comprising color filters or energy band filters to create colored patterns or polyenergetic patterns, and means for effecting motion of either or both aperture plates to create a moving or changing pattern.

27. The system as claimed in claim 1, wherein the radiation source comprises one or more sources of the group consisting of X-rays, gamma rays, radio waves, sound waves, charged atomic particles, uncharged atomic particles, radioactive sources, a neutron flux, fluidized macroscopic particles, debris clouds, accelerated dust, bouncing balls, liquid droplets, aerosol, gas molecules, plasma, ultraviolet light, visible light, infrared radiation, ions, sputtered molecules, evaporated atoms or any other collection of particles or corpuscular radiation.

* * * * *